US010071580B2

(12) United States Patent
Kurasawa

(10) Patent No.: US 10,071,580 B2
(45) Date of Patent: Sep. 11, 2018

(54) PRINTING METHOD AND PRINTING APPARATUS

(71) Applicant: SEIKO EPSON CORPORATION, Tokyo (JP)

(72) Inventor: Mamiko Kurasawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/372,987

(22) Filed: Dec. 8, 2016

(65) Prior Publication Data

US 2017/0165991 A1 Jun. 15, 2017

(30) Foreign Application Priority Data

Dec. 11, 2015 (JP) ..... 2015-241844

(51) Int. Cl.

| | |
|---|---|
| ***B41J 29/393*** | (2006.01) |
| ***B41J 2/205*** | (2006.01) |
| ***B41J 2/01*** | (2006.01) |
| ***B41J 29/38*** | (2006.01) |
| ***B41J 2/165*** | (2006.01) |

(52) U.S. Cl.

CPC ..... *B41J 29/393* (2013.01); *B41J 2/01* (2013.01); *B41J 2/16517* (2013.01); *B41J 2/16579* (2013.01); *B41J 29/38* (2013.01)

(58) Field of Classification Search

CPC ... B41J 29/393; B41J 2/16579; G06K 15/105; G06K 15/102

USPC ..... 347/6, 9, 15, 19

See application file for complete search history.

(56) References Cited

U.S. PATENT DOCUMENTS

| | | | | |
|---|---|---|---|---|
| 6,874,864 | B1 * | 4/2005 | Maeda | B41J 2/5058 347/16 |
| 7,959,253 | B2 * | 6/2011 | Nunokawa | B41J 29/393 347/104 |
| 2008/0037068 | A1 | 2/2008 | Yokoyama et al. | |
| 2010/0079819 | A1 | 4/2010 | Ouchi | |
| 2012/0075372 | A1 | 3/2012 | Yamamoto | |
| 2015/0174911 | A1 * | 6/2015 | Hoshii | B41J 2/07 347/12 |

FOREIGN PATENT DOCUMENTS

| | | | |
|---|---|---|---|
| JP | 2008-044135 | A | 2/2008 |
| JP | 2010-082837 | A | 4/2010 |
| JP | 2011-098546 | A | 5/2011 |
| JP | 2012-071458 | A | 4/2012 |

* cited by examiner

*Primary Examiner* — An Do

(74) *Attorney, Agent, or Firm* — Foley & Lardner LLP

(57) ABSTRACT

A printing method for printing sign information constituted by characters and/or marks on a medium includes a test printing process of printing a plurality of test patters whose ink amounts are mutually different on the medium, a selection receiving process of receiving a selection of legible one test pattern among the plurality of test patterns having been printed on the medium, and an ink amount setting process of setting an ink amount for use in printing of the sign information to an ink amount having been used in the printing of the one test pattern, which has been selected in the selection receiving process.

9 Claims, 8 Drawing Sheets

FIG. 5A

PRINTED PATTERN IS COMPARED WITH PATTERN IN NORMAL STATE.
IF PART OF LINE IS MISSING, CLOGGING IS OCCURRING. PLEASE EXECUTE NOZZLE CLEANING. IF PART OF TEXT IS INVISIBLE OR TEXT BLURRING IS OCCURRING, PLEASE EXECUTE TEXT ADJUSTMENT.

CLEANING TEXT ADJUSTMENT EXIT

FIG. 5B

NOZZLE CHECK ×

ABCD123 EF456

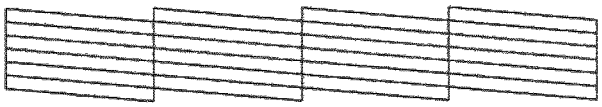

NORMAL

ABCD123 EF456

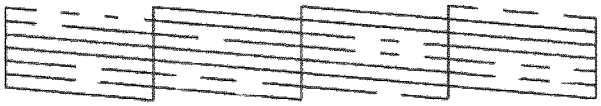

CLEANING IS NEEDED

ABC 23 EF456

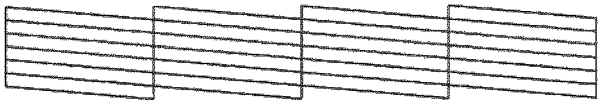

TEXT ADJUSTMENT IS NEEDED

PRINTED PATTERN IS COMPARED WITH ABOVE PICTURE (IN NORMAL STATE).
IF PART OF LINE IS MISSING, CLOGGING IS OCCURRING. PLEASE EXECUTE NOZZLE CLEANING. IF PART OF TEXT IS INVISIBLE OR TEXT BLURRING IS OCCURRING, PLEASE EXECUTE TEXT ADJUSTMENT.

CLEANING TEXT ADJUSTMENT EXIT

PRINTING METHOD AND PRINTING APPARATUS

BACKGROUND

1. Technical Field

The present invention relates to a printing technology for printing sign information constituted by characters and/or marks on a medium.

2. Related Art

In an inkjet printer, an example of printing apparatuses that print images on a medium while ejecting inks onto the medium through nozzles, there occurs a case where sign information, such as characters and/or marks, is printed as needed. For example, when nozzle checking is performed in a printing apparatus, there occurs a case where not only nozzle check patterns but also body information and an error report are printed on the medium. Such information printed on the medium is sign information, such as characters and/or marks, and is printed using an ink of a specific color (typically, a black color) among a plurality of colors. In this case, however, when, during an operation of such a printer, clogging occurs in a nozzle for use in ejecting the black ink, the clogging blocks the ink of the black color from being ejected through the nozzle. Further, this trouble leads to a defect, such as missing of printing or blurring, in printed characters and/or marks, and this defect has sometimes made the printed body information and error report illegible.

Thus, it has been proposed to apply a technology disclosed in JP-A-2012-71458, that is, a technology that allows inks of colors other than the black color to be ejected and formed into inks of a mixed color to generate a black color so as to enable utilization of a so-called composite black color.

Unfortunately, however, clogging states of nozzles for colors other than the black color are unknown, and under a situation where clogging states of some of the nozzles for colors other than the black color have worsened, even though inks having predetermined amounts are ejected through the nozzles to print the body information and the error report, the printed body information and error report have sometimes been difficult to favorably read.

SUMMARY

An advantage of some aspects of the invention is that printing technologies are provided that enable sign information, such as characters and/or marks, to be certainly printed in a legible state.

The invention is realized as printing technologies in accordance with the following aspects of the invention.

According to a first aspect of the invention, a printing method for printing sign information constituted by characters and/or marks on a medium includes a test printing process of printing a plurality of test patters whose ink amounts are mutually different on the medium, a selection receiving process of receiving a selection of legible one test pattern among the plurality of test patterns having been printed on the medium, and an ink amount setting process of setting a first ink amount for use in printing of the sign information to a second ink amount having been used in the printing of the one test pattern, which has been selected in the selection receiving process.

In the printing method configured in accordance with the first aspect of the invention, a plurality of test patterns are printed on the medium. Further, legible one test pattern is selected from among the test patterns, and a second ink amount having been used in the printing of the legible one test pattern is set as a first ink amount for use in printing of the sign information. With this configuration, therefore, the sign information, such as characters and/or marks, is certainly printed in a legible state. It should be noted that "sign information constituted by characters and/or marks" in the first aspect of the invention means information resulting from combining some of characters (ABC . . . 0123 . . . ) and marks (♦■★ . . . ), and includes, for example, a firmware number and error information.

Here, the printing method may further include a determination process of, when the sign information has been printed on the medium using an ink of a specific color, determining whether the printed sign information is legible or illegible. Further, when it has been determined in the determination process that the printed sign information is illegible, the plurality of test patterns may be printed using an ink of a color other than the specific color in the test printing process, and in the ink amount setting process, the first ink amount, which is for use in printing of the sign information, in a case where the ink of the color other than the specific color is used may be set to the second ink amount, which has been used in the printing of the one test pattern, in the case where the ink of the color other than the specific color is used. This is because, when sign information having been printed using a specific color (a black color in lots of cases) is illegible, it is highly likely that this illegibility has occurred due to a failure in ejection of an ink of the specific color. Thus, such printing of the sign information using an ink of a color other than the specific color allows the sign information to be printed without being affected by the failure in ejection of the ink, and is therefore suitable.

Further, in the test printing process, the plurality of test patterns may be printed using a portion of or all of inks of a plurality of colors other than the specific color. This is because, when the failure in the ejection of the ink of the specific color occurs, the ejection of an ink of a color other than the specific color is also likely to be in a failure state. Thus, printing of the test patterns using inks of a plurality of colors other than the specific color increases the variety in the printing of the test patters, and as a result, a possibility that legible one test pattern is selected is increased.

Further, the plurality of test patterns may be the same. This configuration facilitates the selection of the legible one test pattern without being affected by the forms of the test patterns.

Further, each of the plurality of test patterns may be constituted by a set of characters or a set of marks that constitutes the sign information. Here, "a set of characters or a set of marks that constitutes the sign information" means that, for example, when the sign information is always a combination of English capital letters, each of the test patters becomes "ABCDE . . . XYZ". In this way, test patters each constituted by a set of characters or a set of marks that constitutes the sign information are used to obtain an ink amount that produces a legible state and then allow the sign information to be printed using an ink whose ink amount is the same as the obtained ink amount. With this configuration, therefore, the legibility of the sign information is secured with certainty.

Further, each of the plurality of test patterns may be the same as the sign information. In this case, since the sign information itself is handled as each of the plurality of test patterns, the legibility of the sign information is secured with certainty.

Further, as conventionally known, along with the decrease of the remaining amount of an ink, a trouble in which clogging occurs in nozzles through which the ink is ejected and this clogging causes a failure in ejection of the ink is likely to occur, and this trouble is likely to lead to a defect in which the test patterns are not printed favorably. Thus, in order to reduce the occurrence of such a defect, printing of the test patterns in view of remaining amounts is preferable.

With respect to such preferable printing of the test patterns in view of remaining amounts, for example, in the test printing process, at least one ink each having a large remaining amount among inks of a plurality of colors may be preferentially used, and the plurality of test patters may be printed using a portion of or all of the inks of the plurality of colors. Further, in the test printing process, the plurality of test patters may be printed using a portion of or all of inks of a plurality of colors in a way that allows a test pattern constituting the plurality of test patterns and using a large amount of an ink with respect to at least one ink constituting the portion of or the all of the inks of the plurality of colors and each having a large remaining amount to be preferentially printed. Moreover, in the test printing process, a test pattern constituting the plurality of test patterns and using only at least one ink constituting the portion of or the all of the inks of the plurality of colors and each having a large remaining amount may preferentially printed.

According to a second aspect of the invention, a printing apparatus includes a plurality of nozzles configured to allow a plurality of inks to be ejected onto a medium through the plurality of nozzles themselves to print sign information constituted by characters and/or marks on the medium, and a control mechanism configured to control ink amounts of the plurality of inks, which are ejected through the plurality of nozzles. Further, the control mechanism includes a test pattern printing section configured to eject, through the plurality of nozzles, inks constituting the plurality of inks and having mutually different ink amounts to print a plurality of test patterns on the medium, a selection receiving section configured to receive a selection of legible one test pattern among the plurality of test patterns having been printed on the medium, and an ink amount setting section configured to set an ink amount for use in printing of the sign information to an ink amount having been used in the printing of the one test pattern having been selected.

In the printing apparatus configured in accordance with the second aspect of the invention, just like the first aspect, an ink amount having been used in printing of one test pattern having been determined to be legible is set as an amount for use in printing of the sign information. With this configuration, therefore, the sign information, such as characters and/or marks, is certainly printed in a legible state.

It should be noted that all of the plurality of constituent elements in accordance with each of the aforementioned aspects of the invention are not essential, and in order to archive part of or all of advantageous effects described in this patent description, for partial constituent elements among the plurality of constituent elements, their modifications, deletions, replacements with other new constituent elements, and partial deletions of restricted contents may be made when needed. Further, in order to archive part of or all of advantageous effects described in this patent description, part of or all of technical features in accordance with one aspect among the aforementioned aspects of the invention may be combined with part of or all of technical features in accordance with a different aspect among the aforementioned aspects of the invention so as to produce an independent aspect of the invention.

BRIEF DESCRIPTION OF THE DRAWINGS

The invention will be described with reference to the accompanying drawings, wherein like numbers reference like elements.

FIG. 5A is a schematic diagram illustrating an example of a message displayed on a display unit.

FIG. 5B is a schematic diagram for illustrating an example of messages displayed on a printer driver screen.

DESCRIPTION OF EXEMPLARY EMBODIMENTS

Figure 1:
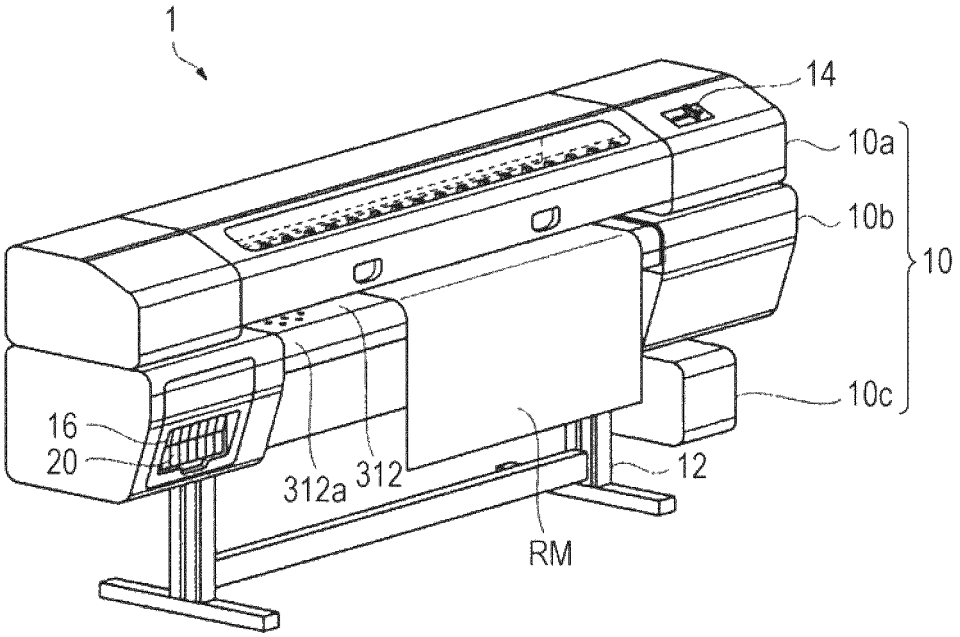
FIG. 1 is a perspective view of an inkjet recording apparatus (printing apparatus) according to an embodiment of the invention illustrating an external view of the inkjet recording apparatus.
Figure 2:
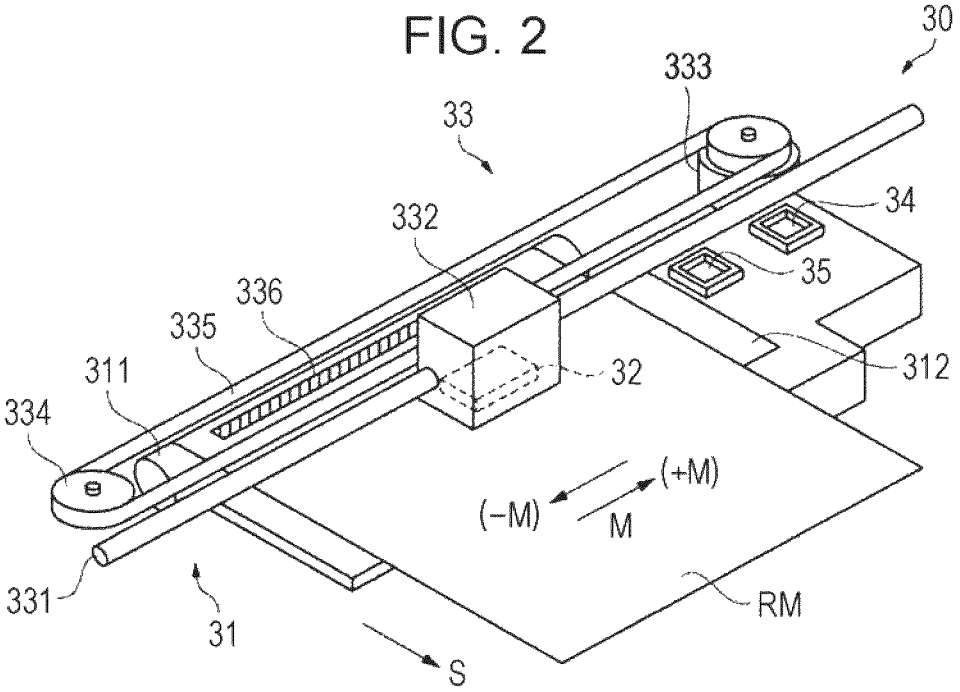
FIG. 2 is a perspective view of the inkjet recording apparatus illustrated in FIG. 1, schematically illustrating an internal mechanism of the inkjet recording apparatus.
Figure 3:
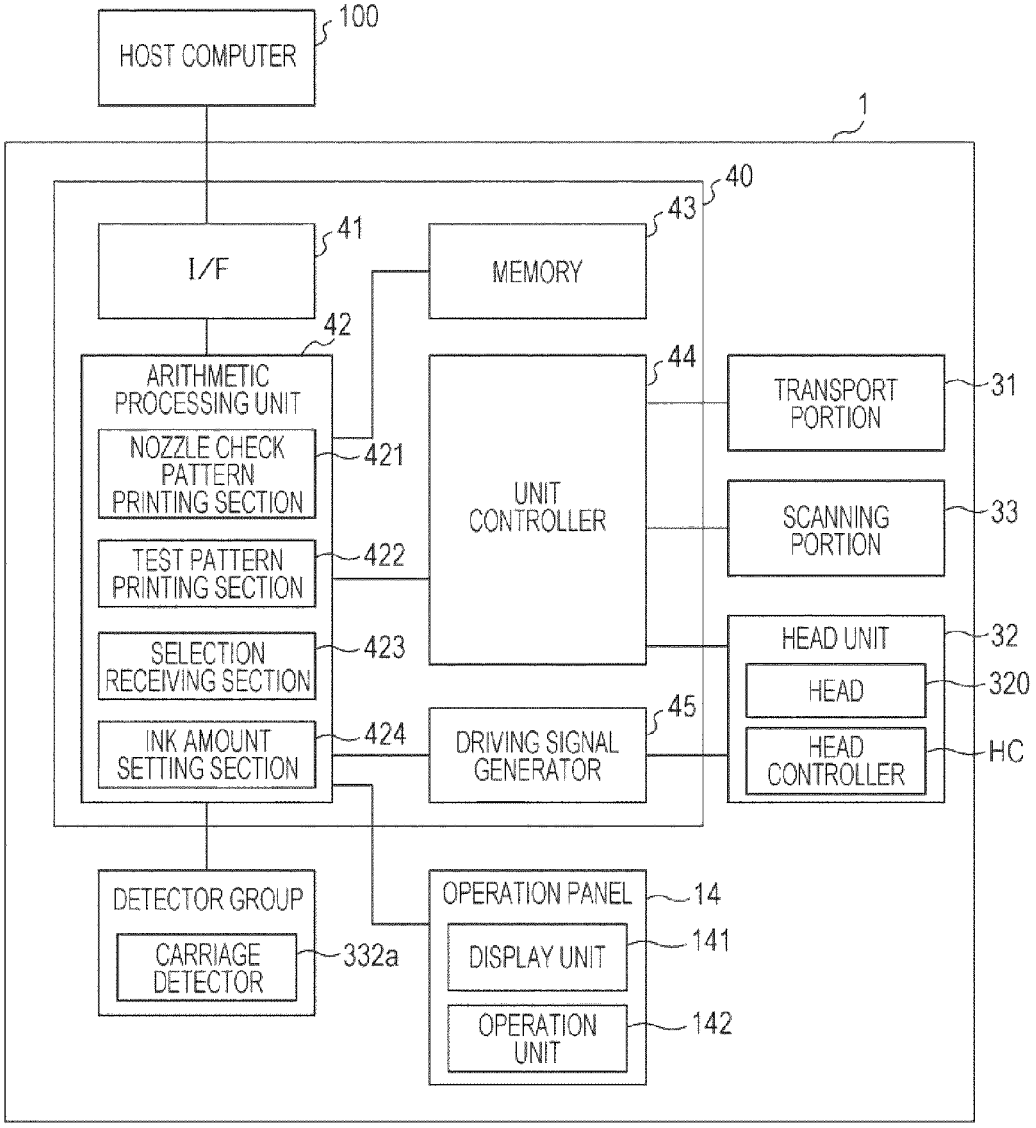
FIG. 3 is a block diagram illustrating an electric configuration of the inkjet recording apparatus illustrated in FIG. 1.

FIG. 1 is a perspective view of an inkjet recording apparatus according to one embodiment of a printing apparatus according to the invention, illustrating an external view of the inkjet recording apparatus. Further, FIG. 2 is a perspective view of the inkjet recording apparatus illustrated in FIG. 1, schematically illustrating an internal mechanism thereof. Moreover, FIG. 3 is a block diagram illustrating an electric configuration of the inkjet recording apparatus illustrated in FIG. 1. Upon receipt of printing data from a host computer 100, an external apparatus, the inkjet recording apparatus 1 prints images corresponding to the printing data on a recording medium RM by ejecting liquid droplets (hereinafter referred to as "ink droplets") of ink constituent substances (hereinafter referred to as just "inks") onto the recording medium RM on the basis of the printing data. Here, with respect to the recording medium RM, not only paper, such as a single paper form of a large size conforming to, for example, A1 size of the JIS standard, and roll paper having the same paper width as that of the single paper form, but also a resign film and any other similar substance may be employed as the recording medium RM.

As shown in FIG. 1, the inkjet apparatus 1 includes a main body 10 and a leg portion 12. The main body 10 is constituted by three kinds of box members, that is, an upper box member 10*a*, a lower box member 10*b*, and a small box member 10*c*. The leg portion 12 supports the main body 10. The upper box member 10*a* and the lower box member 10*b* are vertically stacked with each other. Further, an operation panel 14 is disposed at the right front side of the upper box member 10*a*. This operation panel 14 is constituted by, for example, a liquid crystal display, an organic EL display, or any other similar display, and includes a display unit 141 (FIG. 3) and an operation unit 142 (FIG. 3). The display unit 141 displays various messages and any other piece of information, and the operation unit 142 includes various switches and any other component. Further, a cartridge holder 16 is disposed at the left front side of the lower box member 10*b*, and ink cartridges 20 are mounted in this cartridge holder 16. Further, in each of the ink cartridges 20, a corresponding one of inks are contained. In this embodiment, the ink cartridges 20 are disposed independently from each other, and in each of the ink cartridges 20, a corresponding one of inks in cyan (C), magenta (M), yellow (Y), and black (K) is stored. Further, inks of colors whose ink amounts are specified for each of the colors are given to the recording medium RM so as to allow color images to be printed on the recording medium RM.

Although omitted from illustration in FIG. 1, a spindle is horizontally disposed in a rear portion (a back side portion in FIG. 1) of the lower box member 10*b*, and a roll is attached to the spindle. Further, a pre-printing long recording medium RM is wounded around the roll. The inkjet recording apparatus 1 is configured to enable this recording medium RM to be drawn from the roll to a portion between the upper box member 10*a* and the lower box member 10*b*, and allow a transport portion 31 of an internal mechanism 30 to feed the recording medium RM to the front side to allow a head unit 32 to print images on the fed recording medium RM. The recording medium RM, having been subjected to the printing in this way, is further fed to the front side (a near side portion in each of FIGS. 1 and 2) of the main body 10 by the transport portion 31, and then, drops downward due to its weight.

Next, the internal mechanism 30 will be described referring to FIG. 2. The internal mechanism 30 includes, in addition to the above-described transport portion 31 and head unit 32, a scanning portion 33 for moving the head unit 32, a cap portion 34, a flushing portion 35, and any other mechanical portion.

The transport portion 31 includes a transport motor (not illustrated), a transport drive roller 311, a transport driven roller (not illustrated), a suction platen 312, and any other transport component. The transport drive roller 311 and the suction platen 312 are arranged in this order along a transport direction S of the recording medium RM. The transport drive roller 311 is contained inside the upper box member 10*a*. Meanwhile, the suction platen 312 is contained inside the lower box member 10*b*. Further, upon actuation of the transport motor in response to a control command from a unit controller 44 (FIG. 3) of a controller 40 for controlling the entire apparatus, the transport motor drivingly rotates the transport drive roller 311, and the transport drive roller 311 rotates pressing the recording medium RM so as to feed the recording medium RM to a portion on the suction platen 312 disposed at the front side of the transport drive roller 311.

The suction platen 312 includes a horizontal, flat surface, and supports the recording medium RM, having been fed onto the surface by the transport drive roller 311, from below. The suction platen 312 includes a large number of suction holes communicated with a pressure decreasing source, such as a suction fan, on its surface, and suctions the recording medium RM. With this configuration, the suction platen 312 brings the recording medium RM having been curled to a flat state, and keeps it in the flat state at a portion below the head unit 32. Further, a smooth guide face 312*a* is formed at a front end portion of the suction platen 312, and smoothly and downwardly guides the forwardly fed recording medium RM.

As shown in FIG. 3, the head unit 32 includes a head 320 and a head controller HC. The head 320 includes a plurality of nozzles, and allows ink droplets to be intermittently ejected through each of the nozzles in accordance with a drive command from the head controller HC while being moved in a movement direction M (FIG. 2) by the scanning portion 33. With this operation, dotted lines (raster lines) along the movement direction M are formed on the recording medium RM. The details of the head 320 will be described later.

As shown in FIG. 2, the scanning portion 33 includes a guide rail 331, a carriage 332, and a carriage motor 333, and any other scanning component. The guide rail 331 is disposed so as to horizontally extend in its long-side direction inside the upper box member 10*a*. Further, the carriage 332 mounts the head unit 32, and is disposed so as to horizontally reciprocate (scan) along the guide rail 331, that is, in the movement direction M, while being supported by the guide rail 331.

A timing belt 335 is disposed at the rear side of the guide rail 331 so as to be laid across a pair of pulleys 334. One of the pulleys 334 is coupled to a rotation shaft (omitted from illustration) of the carriage motor 333. The timing belt 335 is disposed so as to be movable in parallel to the guide rail 331 between the pair of pulleys 334. Further, a portion of the timing bolt 335 is coupled to the carriage 332. With this configuration, therefore, upon actuation of the carriage motor 333 in response to a control command from the unit controller 44, the carriage 332 moves in the movement direction M.

Further, a linear scale 336 is disposed in parallel to the movement direction M. The linear scale 336 includes a transparent body and light shielding bars formed at constant intervals along the movement direction M. Meanwhile, the carriage 332 includes a carriage detector 332*a* (FIG. 3) for detecting the light shielding bars. With this configuration, therefore, the result of the detection by the carriage detector 332*a* is output to the controller 40 so as to enable the controller 40 to accurately detect the amount of the movement of the carriage 332.

In this way, the scanning portion 33 allows the head unit 32 to accurately move and scan to allow ink droplets to be ejected onto the recording medium RM to form an image formation region, that is, a region on which images are formed, on the recording medium RM. Here, a region other than the image formation region on the surface of the recording medium RM corresponds to a non-image formation region. Further, the carriage 332 is configured to be movable across the recording medium RM in the movement direction M, and the flushing portion 35 and the cap portion 34 are serially disposed as maintenance units in a region at the outside of the suction platen 312 in the movement direction M. Further, the head unit 32 is configured to, upon actuation of the carriage motor 333 in response to a control command from the unit controller 44, be capable of moving to each of a portion above the flushing portion 35 and a portion above the cap portion 34. For example, the carriage 332 (the head unit 32) is caused to move to the portion above the flushing portion 35 to eject inks through predetermined ones of the nozzles so as to be subjected to a flushing operation. Meanwhile, the flushing portion 35 absorbs the ejected inks. With such a flushing operation, inks with their viscosities increased are eliminated from the head unit 32, and thereby, cleaning processing on the nozzles is performed.

Further, the cap portion 34 air-tightly seals the lower face of the head unit 32 during a halt of the operation of the inkjet recording apparatus 1 to prevent the viscosity increase or hardening of inks in the head unit 32.

It should be noted that, in this embodiment, as shown in FIG. 2, the flushing portion 35 is disposed at only one outside of the scanning region of the head unit 32, but the disposition of the flushing portion 35 is not limited to this configuration and the flushing portion 35 may be disposed at both outsides of the scanning region. The disposition of the flushing portion 35 at each of both outsides of the scanning region enables the length of the scanning region to be made longer, provided that a flushing time interval is the same.

In the inkjet recording apparatus 1 having such a configuration as described above, along with the increase of usage frequencies thereof, a case where flogging of an ink occurs in a nozzle and this flogging causes a failure of the ejection of an ink through the nozzle is likely to occur. In such a case, upon receipt of a nozzle check command issued by a user and transferred via the operation panel 142 of the operation panel 14 or a printer driver installed in the host computer 100, the controller 40 controls the individual portions of the inkjet recording apparatus 1 to perform a nozzle maintenance operation including a nozzle check pattern printing processing, text adjustment processing, the cleaning processing, and any other processing. In this way, in this embodiment, the controller 40 serves as the "control mechanism" according to the second aspect of the invention.

The controller 40 controls the individual portions of the inkjet recording apparatus 1 on the basis of the printing data having been received from the host computer 100 to, not only perform printing of images corresponding to the printing data on the recording medium RM, but also perform the nozzle maintenance operation described above. The controller 40 includes an interface unit 41, an arithmetic processing unit 42 constituted by a central processing unit (CPU) and any other component, a memory 43, the unit controller 44, and a driving signal generator 45. The interface unit 41 transmits/receives data between the host computer 100, which is a host apparatus, and the inkjet recording apparatus 1. The arithmetic processing unit 42 performs arithmetic processing for controlling the entire inkjet recording apparatus 1. The memory 43 is a memory device for securing in itself an area for storing a program and its work area that are for use in the arithmetic processing unit 42, and includes memory elements, such as random access memory (RAM) elements and electrical erasable programmable read-only memory (EEPROM) elements. The arithmetic processing unit 42 controls the transport portion 31, the head unit 32, the scanning portion 33, and any other portion in accordance with the program stored in the memory 43. Moreover, the driving signal generator 45 generates driving signals for driving the head 320.

Figure 4:
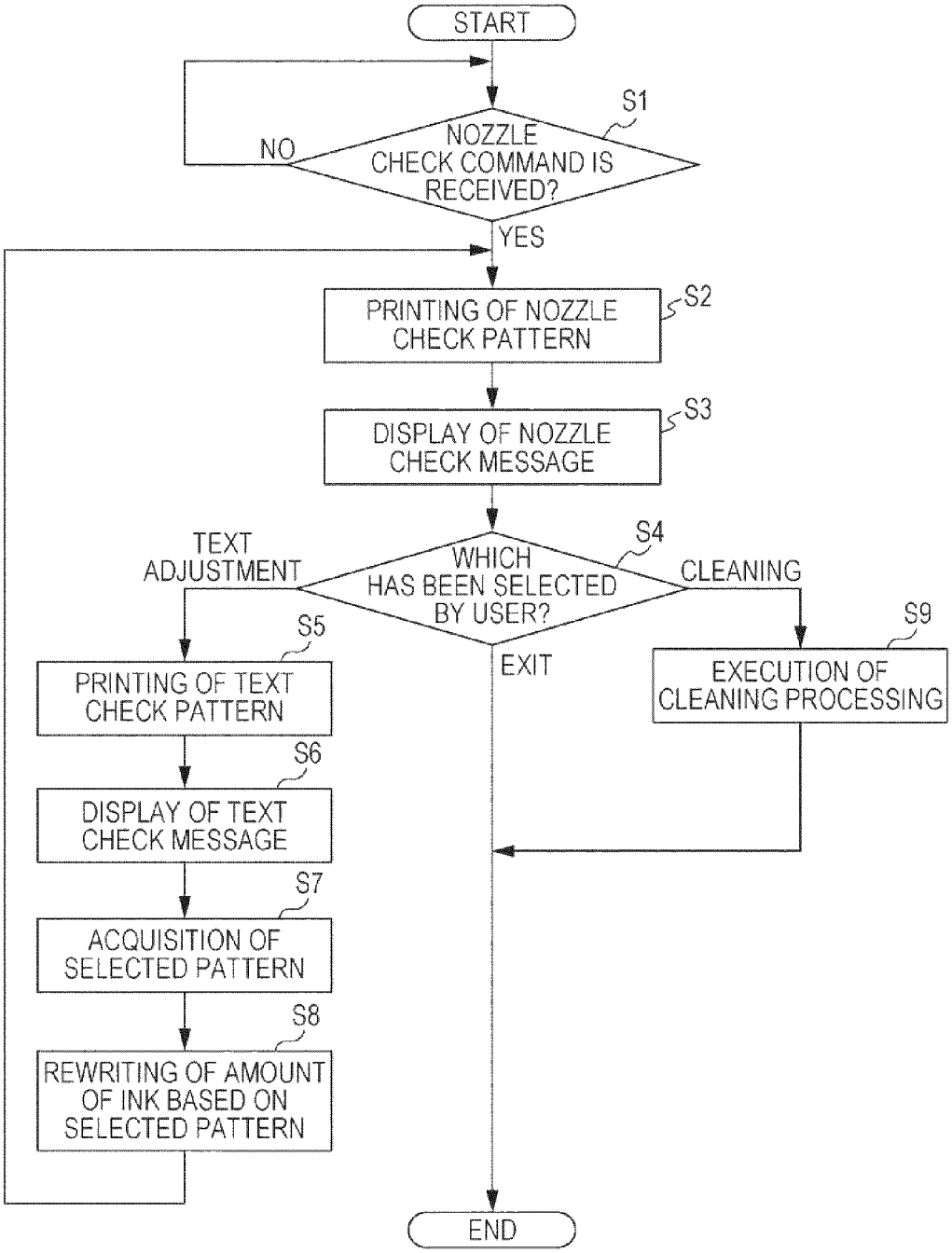
FIG. 4 is a flowchart illustrating an example of nozzle maintenance operation.

Further, in this embodiment, the arithmetic processing unit 42 performs the nozzle maintenance operation shown in FIG. 4 in accordance with a nozzle maintenance program stored in the memory 43 to serve as a nozzle check printing section 421, a test pattern printing section 422, a selection receiving section 423, and an ink amount setting section 424. Here, the nozzle check printing section 421 is a constituent for printing nozzle check patterns and text information on the recording medium RM. Further, the test pattern printing section 422 is a constituent for printing text check patterns 5 on the recording medium RM. Further, the selection receiving section 423 is a constituent for receiving a selection of legible one test pattern among a plurality of test patterns. Moreover, the ink amount setting section 424 is a constituent for setting an ink amount for use in printing of the text information in accordance with a selection made by a user. Hereinafter, the nozzle maintenance operation will be described referring to FIGS. 4 to 7.

Figure 6:
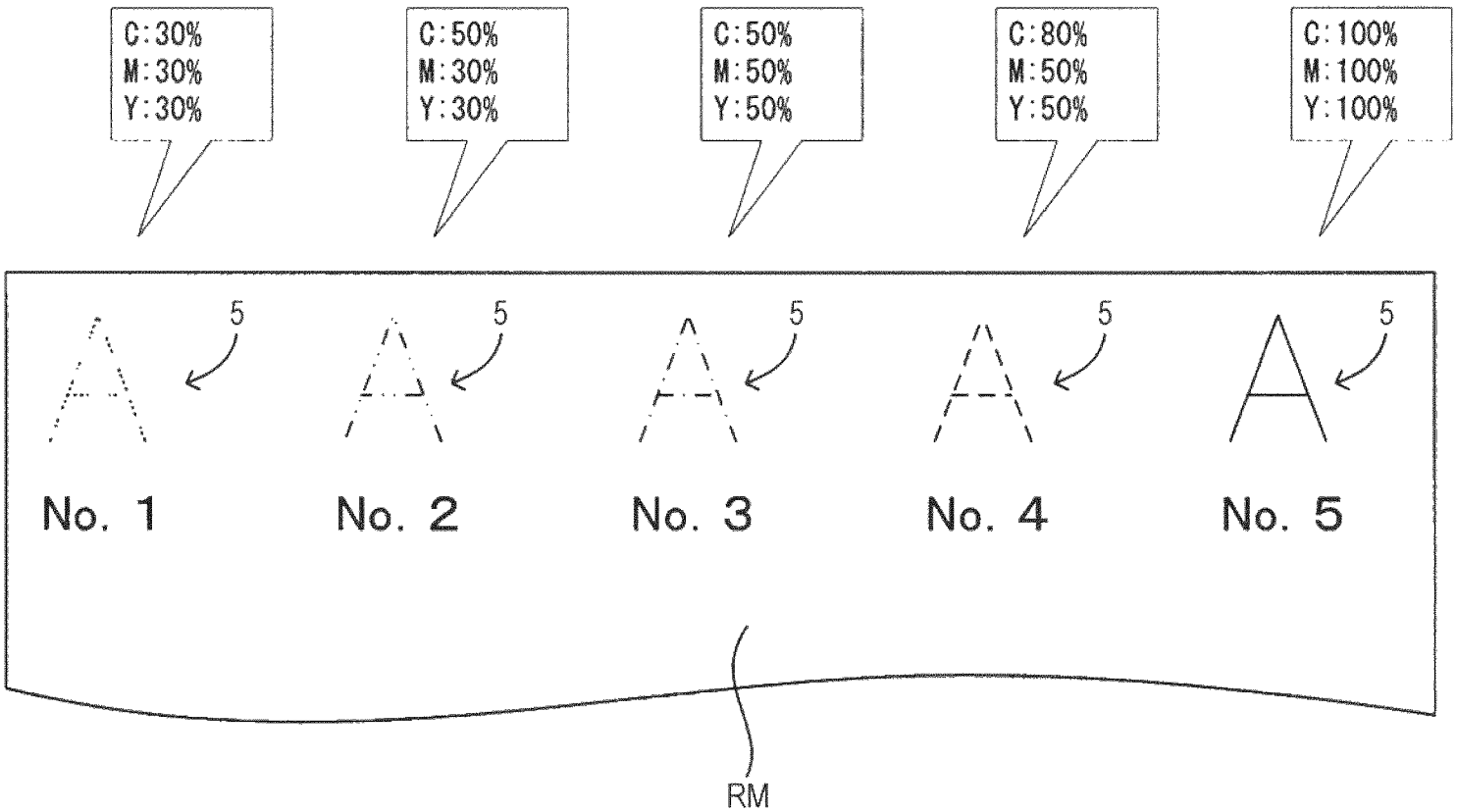
FIG. 6 is a diagram illustrating an example of text check patterns.
Figure 7:
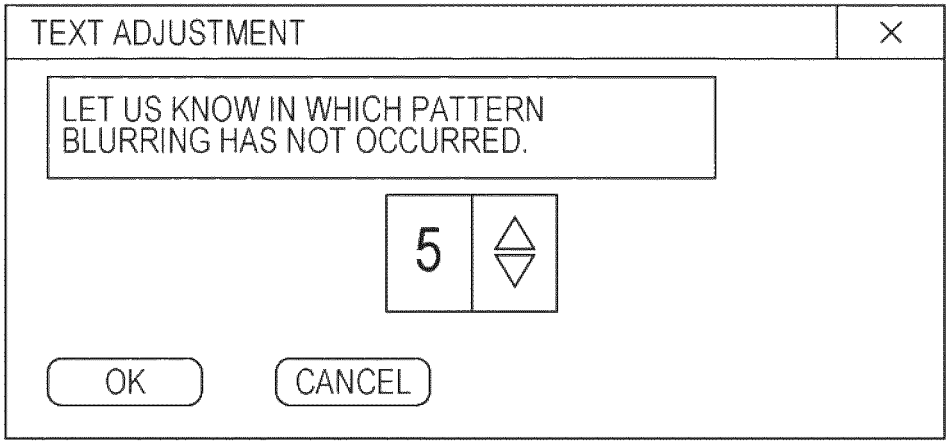
FIG. 7 is a schematic diagram illustrating an example of a message displayed on a display unit or a printer driver screen.

FIG. 4 is a flowchart illustrating an example of the nozzle maintenance operation performed by the inkjet recording apparatus 1 illustrated in FIG. 1. Further, FIG. 5A is a schematic diagram illustrating an example of a message displayed on the display unit 141 after an execution of printing processing for printing nozzle check patterns, and FIG. 5B is a schematic diagram for illustrating an example of messages displayed on a printer driver screen of the host computer 100 after an execution of printing processing for printing nozzle check patterns. Further, FIG. 6 is a diagram illustrating an example of text check patterns. Moreover, FIG. 7 is a schematic diagram illustrating an example of a message displayed on the display unit 141 or the printer driver screen during an execution of text adjustment processing.

In the inkjet recording apparatus 1, upon receipt of a nozzle check command by a user via the operation unit 142 or the printer driver ("YES" in step S1), the nozzle check printing section 421 of the arithmetic processing unit 42 controls the individual portions of the inkjet recording apparatus 1 on the basis of printing data corresponding to nozzle check patterns and stored in the memory 43 in advance to print, for each color, images of nozzle check patterns (for example, see FIG. 5B) on the recording medium RM (step S2). Further, text information including body information, error reports, and any other piece of information is printed using a specific color (typically, a black color) on the recording medium RM together with the nozzle check patterns. Here, the nozzle check patterns and the text information may be printed on either a recording medium RM for use in nozzle checking or a non-printing region being not subjected to printing of printing target images of a printing command from the host computer 100 and existing on the surface of a recording medium RM for use in typical printing for printing the printing target images.

Further, after the completion of printing of the nozzle check patterns and the text information, a nozzle check message is displayed (step S3). In the case where the nozzle check command is given by a user via the operation unit 142 of the operation panel 14, for example, a message shown in FIG. 5A is displayed. Meanwhile, in the case where the nozzle check command is given by a user via the printer driver, a message shown in FIG. 5B is displayed on a display (omitted from illustration) of the host computer 100. After having read the message, the user observes the nozzle check patterns and the text information, which have been printed on the recording medium RM for use in the nozzle checking, and determines the necessity/unnecessity of each of the cleaning processing and the text adjustment (step S4: a determination process). Here, in this embodiment, three options, that is, "text adjustment", "cleaning", and "exit", are provided. When "text adjustment" is selected in step S4, text adjustment processing (steps S5 to S8) is executed. When "cleaning" is selected in step S4, cleaning processing (step S9) is executed. Further, "exit" is selected in step S4, the nozzle maintenance operation is terminated. It should be noted that the nozzle maintenance operation performed in this embodiment is commonly known, and thus, the detailed description of the nozzle maintenance operation is omitted here.

In the text adjustment processing, the text pattern printing section 422 of the arithmetic processing unit 42 controls the individual portions of the inkjet recording apparatus 1 on the basis of printing data corresponding to the text check patterns 5 and stored in the memory 43 in advance. With this operation, images of the text check patterns 5 are printed using inks of colors other than the black color on a recording medium RM for use in the text adjustment (step S5: a test printing process). That is, typically, the text information is printed using the black ink, and when clogging has occurred in a nozzle for ejecting the black ink, the text information becomes unclear, and thus, "text adjustment" described above is selected. In this embodiment, therefore, for example, as shown in FIG. 6, a plurality of text check patterns 5 (each being an English capital letter "A" in FIG. 6) are printed on the recording medium RM together with text numbers in a way that allows, for each of the text check pattern 5, the ink amount of each of inks of colors other than the black color to be changed. Here, in this embodiment, five kinds of text check patterns 5 having mutually different combinations of ink amounts are printed, but the number of the text check patterns 5 is not limited to "five", and may be optionally determined, provided that the number is a plural number. Further, the text check patters 5 may be printed on the recording medium RM for use in the text adjustment, or may be printed on a recording medium RM on which nozzle check patters and any other image are already printed. Further, the text check patters 5 may be printed on a non-printing region exiting on the surface of a recording medium RM for use in typical printing and being not subjected to printing of the printing target images.

Upon completion of the printing of the text check patterns 5, as shown in FIG. 7, a text check message in relation to the text check is displayed on the display unit 141 or the printer driver screen of the computer 100 to prompt a user to input a number of a text check pattern 5 having no blurry portion and being legible (step S6). Further, upon push operation of an OK button by a user after his or her selection of the number of the text check pattern 5 having been legibly printed, the selection receiving section 423 receives the selection by the user, and acquires the selected text check pattern 5 as "legible one test pattern" (step S7: a selection receiving process). Thereafter, the process flow proceeds to next step S8. Meanwhile, upon push operation of "cancel", the text adjustment processing is halted and the maintenance operation is terminated. Here, the configuration may be made such that, instead of the halt of the text adjustment processing, the process flow returns to step 4 after the change of the settings of the ink amounts of the inks for each of the text check patterns 5, and then, a selection by the user is awaited. Here, upon selection of "text adjustment", the text adjustment processing is retried using the inks whose ink amounts have been changed.

In step S8, the ink amount setting section 424 rewrites the ink amounts for use in printing the text information into ink amounts corresponding to the number having been selected by the user, and thereby new ink amounts are set (step S8: an ink amount setting process). Further, the process flow is caused to return to step S2, where nozzle check patterns and text information are printed again to enable the user to confirm that the text adjustment has been appropriately performed. Further, the configuration may be made such that, instead of returning from step S8 to step S2, the process flow returns to step S4, where a selection by the user is awaited.

As described above, in the above embodiment, the plurality of test check patterns 5, having mutually different combinations of ink amounts and being one embodiment of the "test patterns" according to the first aspect of the invention, are printed. Further, upon selection of one legible text check pattern 5 from among the printed test check patterns 5, ink amounts having been used in the printing of the text check pattern 5 are set as ink amounts for use in printing of sign information. With such an ink amount setting, therefore, the text information is certainly printed always in a legible state on the recording medium RM.

Further, in the above embodiment, when determined that text information having been printed on the recording medium RM using a specific color (black) is illegible, that is, when "text adjustment" is selected in step S4, ink amounts of inks of colors other than the specific color (the colors being cyan, magenta, and yellow in this embodiment) are set so as to allow the inks of colors other than the specific color to be used in printing of text information, and allow the text information to be printed using the inks having the ink amounts having been set. With this configuration, therefore, the text information is certainly printed. That is, when the text information having been printed using an ink of a specific color is illegible, this situation is considered to be highly likely due to a failure of ejection of the ink of the specific color. Thus, in this embodiment, the text information is printed using inks of colors other than the specific color. With this configuration, therefore, the text information is favorably printed without being affected by the ejection failure.

Further, in the above embodiment, a plurality of text check patters 5 are printed using all of inks of colors other than the specific color, and one legible text check pattern 5 is selected from among them. With this configuration, therefore, the variety in the printing of the text check patterns 5 is increased, and as a result, a possibility that legible one test pattern is selected is increased. Consequently, the text information is certainly printed in a legible state on the recording medium RM.

Further, in the above embodiment, the plurality of text check patterns 5 are the same pattern, that is, "A", and thus, a user is able to easily select the one legible text check pattern 5 without being affected by the forms of the text check patterns 5.

It should be noted that the invention is not limited the above embodiment, and various changes may be made on the aforementioned configurations within a scope departing from the gist of the invention. For example, in the above embodiment, as shown in FIG. 6, the text check patterns 5 are composed of one character, that is, specifically, the text check patterns 5 are composed of "A", but, the number, kinds, and any other form of characters constituting the text check pattern 5 are not limited to those of the above embodiment, and may be optionally determined. For example, the text check patterns 5 may be composed of a plurality of characters, such as "ABCDE . . . XYZ", or may be caused to coincide with the text information. For example, when body information is printed as text information together with nozzle information, the body information may be used as the text check patterns 5. In this case, the legibility of the text information, such as body information, is secured with certainty.

Further, in the above embodiment, text information constituted by a set of characters is printed as the "sign information" according to the first aspect of the invention, but the invention is suitably applied to a printing technology that allows information constituted by a set of marks including ♦■★ . . . , or information obtained by combining a set of characters and a set of marks to be used as the "sign information" according to the first aspect of the invention. Accordingly, with respect to the "test patterns" according to the first aspect of the invention, not only text check patterns constituted by only a set of characters, such as the text check patterns 5 in the above embodiment, but also check patterns including at least one set of marks may be used.

Figure 8:
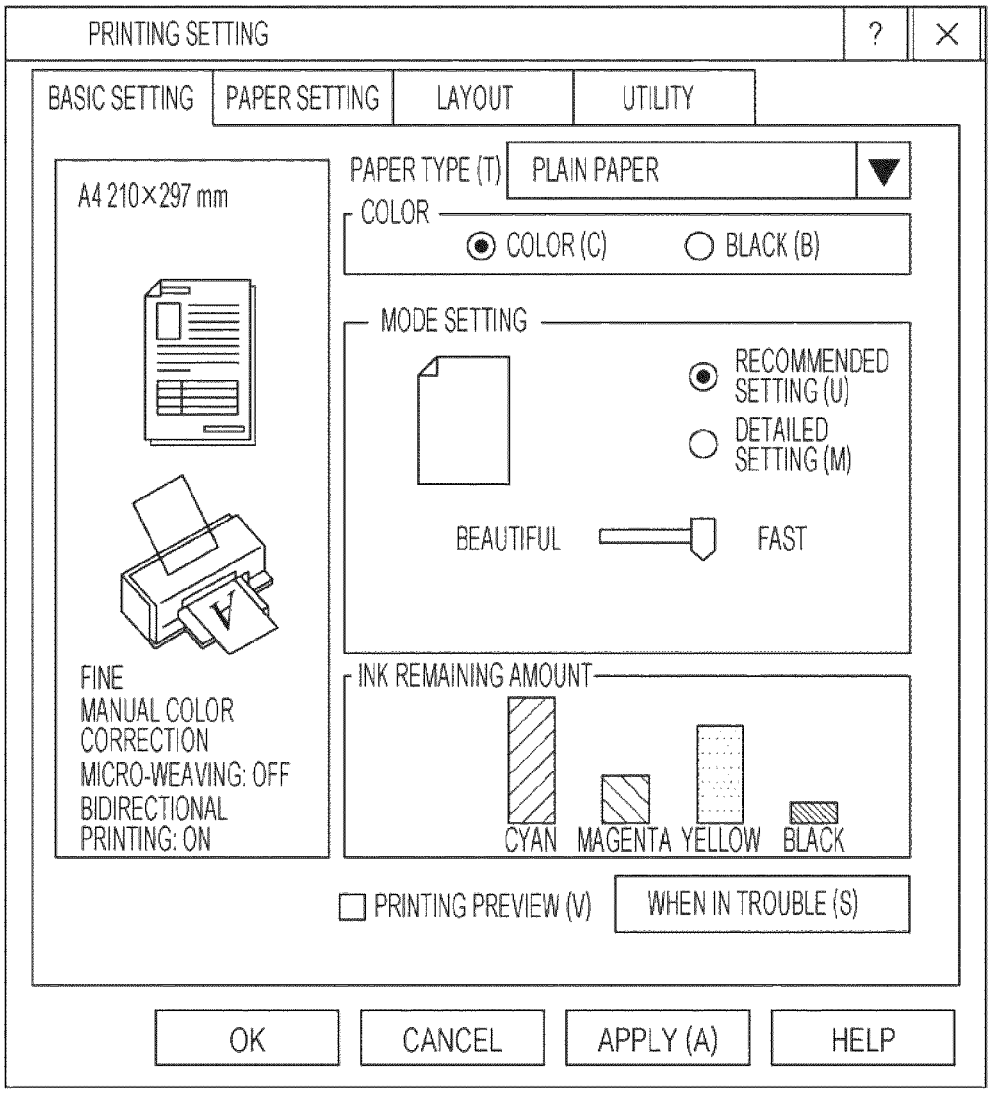
FIG. 8 is a diagram illustrating an example of a display of ink remaining amounts on a printer driver screen.
Figure 9:
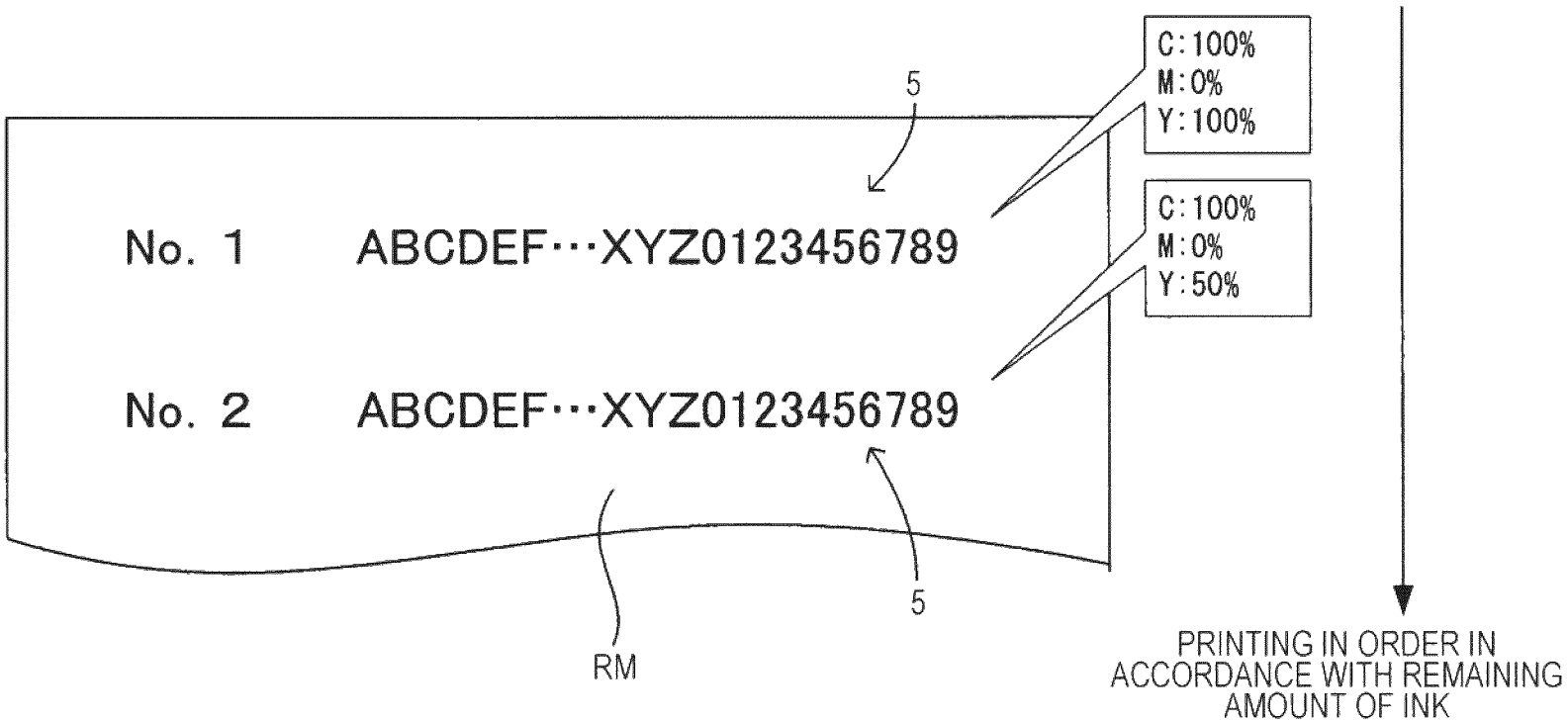
FIG. 9 is a diagram illustrating another example of text check patterns.

Further, in the above embodiment, the amounts of inks each remaining in a corresponding one of the ink cartridges 20 are not particularly taken into account, but are preferable to be taken into account in printing of the test patterns. This is because, along with the decrease of the remaining amount of an ink, a trouble in which clogging occurs in nozzles through which the ink is ejected and this clogging causes a failure in ejection of the ink is likely to occur, and this trouble is likely to lead to a defect in which the test patterns are not printed favorably. For example, as shown in FIG. 8, even for inks of colors other than a specific color (black), there occurs a case where the remaining amount of an ink of a color (magenta in FIG. 8) among the colors decreases. In such a case, for example, as shown in FIG. 9, inks whose remaining amounts are relatively large (an ink of cyan and an ink of yellow in FIG. 9) are preferentially used, and test patterns may be printed using part of or all of these inks on the recording medium RM.

Further, a test pattern configured to use a larger amount of an ink with respect to an ink having a larger remaining amount is preferentially printed. For example, the usage ratios of composites of inks for use in a test pattern may be determined in accordance with the remaining amounts of the inks. In the case where the remaining amounts of a cyan ink, a magenta ink, and a yellow ink are 80%, 30%, and 60%, respectively, the usage ratios of composites of the cyan ink, the magenta ink, and the yellow ink may be set such that:

Usage ratio of composite of cyan ink=80/(80+30+60)=47%

Usage ratio of composite of magenta ink=30/(80+30+60)=18%

Usage ratio of composite of yellow ink=60/(80+30+60)=35%

In this case, the test pattern is printed without using one or more inks each having a relatively small remaining amount, and thus, the occurrence of the above defect is reduced.

Further, when a test pattern is printed under a condition in which the total ink duty of composites of three color inks is 300%, the test pattern may be printed such that:

Ink duty of cyan=141%

Ink duty of magenta=54%

Ink duty of yellow=105%

Here, the "ink duty" means a recording duty of each of inks for use in printing of a test pattern.

The usage ratios may be determined in accordance with the remaining amounts of the inks. For example, the ink duty (the above 54%) to be used for magenta may be split into 30.95% and 23.05% to be respectively given to cyan and yellow in accordance with the remaining amount of cyan and the remaining amount of yellow.

That is, the test pattern may be printed such that:

Ink duty of cyan=172% (=141+30.95)

Ink duty of magenta=0%

Ink duty of yellow=128% (=105+23.05)

Moreover, the configuration may be made such that the test pattern is printed using only inks whose remaining amounts are large. For example, the test pattern may be printed such that only inks each having a remaining amount larger than or equal to a predetermined amount (for example, 30%) in a corresponding one of the ink cartridges 20, that is, cyan and yellow in this case, are used so as to allow the ink duty of each of the inks to be equal to 100%.

Moreover, when text check patterns have been printed, in order to deal with a situation where all of the text check patterns are illegible because of their blurry conditions, a message "Do you want to print text check patterns again in a higher density than a current one?" may be displayed on the display unit. In this case, the printing may be performed in a state in which the ink duty is equal to 200% equivalent to a density value that is twice a typical density value. Moreover, when still, the printed text check patterns are in blurry conditions and are illegible, the ink duty may be stepwise increased to 300% equivalent to a density value that is three times the typical density value. Further, when the stepwise increased ink duty has reached to an ink duty value equivalent to a density value beyond which the density is not permitted to be increased, an alarm notification "Density cannot be increased any more. Please perform maintenance or contact the support center" may be displayed.

This application claims priority under 35 U.S.C. § 119 to Japanese Patent Application No. 2015-241844, filed Dec. 11, 2015. The entire disclosure of Japanese Patent Application No. 2015-241844 is hereby incorporated herein by reference.

What is claimed is:

1. A printing method for printing sign information constituted by characters and/or marks on a medium, the printing method comprising:

a determination process including determining that printed sign information is illegible, the sign information having been printed on the medium using an ink of a specific color and using a first ink amount;

a test printing process of printing a plurality of test patterns whose ink amounts are mutually different on the medium and which include at least one color different from the specific color used for printing the sign information;

a selection receiving process of receiving a selection of a test pattern of the plurality of test patterns determined to be legible; and an ink amount setting process of changing an ink amount for use in another printing of the sign information from the first ink amount to a second ink amount having been used in the printing of the selected test pattern including the at least one color different from the specific color used for printing the sign information.

2. The printing process according to claim 1, wherein, in the test printing process, the plurality of test patterns are printed using a portion of or all of inks of a plurality of colors other than the specific color.

3. The printing process according to claim 1, wherein the plurality of test patterns are the same.

4. The printing process according to claim 3, wherein each of the plurality of test patterns is constituted by a set of characters or a set of marks that constitutes the sign information.

5. The printing process according to claim 3, wherein each of the plurality of test patterns corresponds to the sign information.

6. The printing process according to claim 1, wherein, in the test printing process, at least one ink each having a large remaining amount among inks of a plurality of colors is preferentially used, and the plurality of test patters are printed using a portion of or all of the inks of the plurality of colors.

7. The printing method according to claim 1, wherein, in the test printing process, the plurality of test patters are printed using a portion of or all of inks of a plurality of colors in a way that allows a test pattern constituting the plurality of test patterns and using a large amount of an ink with respect to at least one ink constituting the portion of or the all of the inks of the plurality of colors and each having a large remaining amount to be preferentially printed.

8. The printing method according to claim 7, wherein, in the test printing process, a test pattern constituting the plurality of test patterns and using only at least one ink constituting the portion of or the all of the inks of the plurality of colors and each having a large remaining amount is preferentially printed.

9. A printing apparatus comprising:

a plurality of nozzles configured to allow a plurality of inks to be ejected onto a medium through the plurality of nozzles to print sign information constituted by characters and/or marks on the medium; and a control mechanism configured to control ink amounts of the plurality of inks, which are ejected through the plurality of nozzles, the control mechanism including:

a test pattern printing section configured to eject, through the plurality of nozzles, inks constituting the plurality of inks and having mutually different ink amounts and which include at least one color different from a specific color used for printed sign information that was printed on the medium, that was determined to be illegible, and that was printed using a first ink amount, to print a plurality of test patterns on the medium, a selection receiving section configured to receive a selection of a test pattern of the plurality of test patterns determined to be legible, and an ink amount setting section configured to change an ink amount for use in printing of the sign information from the first ink amount to a second ink amount used in the printing of the selected test pattern including the at least one color different from the specific color used for printing the sign information.

* * * * *